United States Patent [19]

Vincze

[11] Patent Number: 4,776,260

[45] Date of Patent: Oct. 11, 1988

[54] CONSTANT PRESSURE PUMP

[76] Inventor: Alexander L. Vincze, 390 Abbay Way, Sparks, Nev. 89431

[21] Appl. No.: 204,947

[22] Filed: Nov. 7, 1980

[51] Int. Cl.[4] ..... F04B 1/18

[52] U.S. Cl. ..... 92/86; 417/269; 92/162 R

[58] Field of Search ..... 92/86, 162, 86.5, 126, 92/127, 155; 417/269, 437

[56] References Cited

U.S. PATENT DOCUMENTS

| | | | |
|---|---|---|---|
| 1,550,767 | 8/1925 | Weaver | 417/900 |
| 1,597,161 | 8/1926 | Kellogg et al. | 92/86.5 |
| 1,871,989 | 8/1932 | Heitger | 92/86 |
| 1,922,121 | 8/1933 | Brown | 92/86 |
| 2,888,879 | 6/1959 | Gaarder | 92/155 |
| 3,035,879 | 5/1962 | Hanny et al. | 92/162 R |
| 3,073,255 | 1/1963 | Gratzmuller | 92/86.5 |
| 3,142,262 | 7/1964 | Firth et al. | 92/127 |
| 3,153,987 | 10/1964 | Thoma | 92/127 |
| 3,391,612 | 7/1968 | Sween | 29/156.5 R |
| 3,495,544 | 2/1970 | Enssle | 417/568 |
| 3,738,230 | 6/1973 | Consi | 92/86 |
| 3,847,062 | 11/1974 | Sutyak | 92/127 |
| 3,954,048 | 5/1976 | Houser | 417/269 |
| 4,304,410 | 12/1981 | Erickson | 92/162 R |

*Primary Examiner*—William L. Freeh

[57] ABSTRACT

An improved pump is provided for pumping non-lubricating fluids at extremely high pressure while reducing galling and wear on components such as pistons and cylinders. The reduction in component wear and galling is achieved by modifying the piston-cylinder combination to provide a pressure area and a centering area that is axially displaced from the pressure area of the piston-cylinder combination. The pressure area of the piston-cylinder combination is modified by reducing the diameter of the piston or increasing the inside diameter of the cylinder or both to provide a 0.1 percent to 2.5 percent increase in clearance at the pressure end of the piston-cylinder combination than is provided at a centering area. The advantages of the invention are further enhanced by employing a release area disposed intermediate the pressure area and the centering area of the piston-cylinder combination. The pressure end of the piston-cylinder combination in conjunction with a release area further augments the advantages of the improved high pressure pump and provides a fluid relief in the event of seal failure so that a pumped non-lubricating fluid is not contaminated with a piston lubricating fluid. The combination of the pressure end of the piston-cylinder combination in conjunction with the release area allows the pressure end of the piston to operate in a virtually dry condition except for the fluid being pumped by the seal on the end of the piston. The further combination of the release area with the centering area of the piston-cylinder combination operates to reduce galling and increase efficiency and component life of high pressure pumps.

24 Claims, 3 Drawing Sheets

FIG. 2
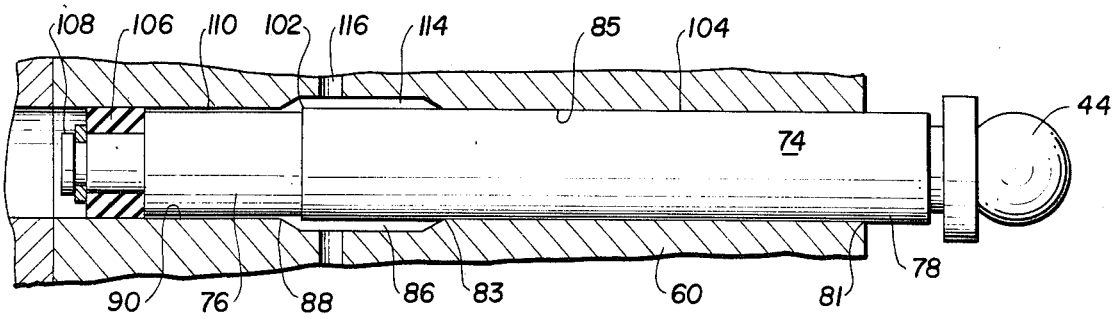
FIG. 3
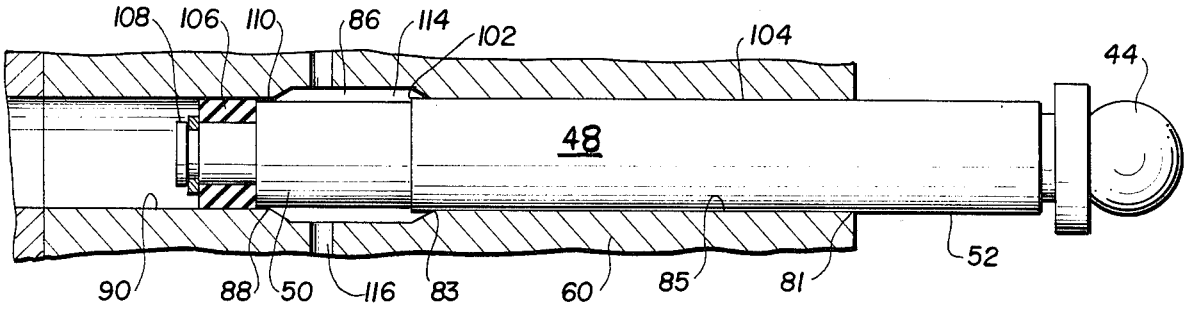
FIG. 4
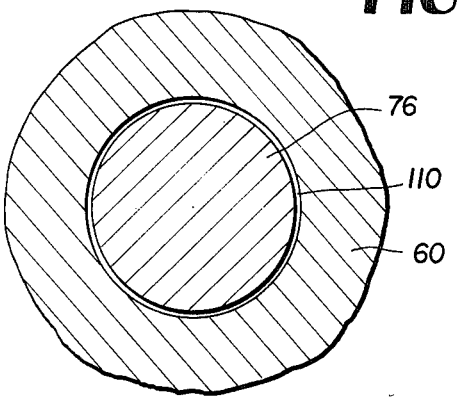
FIG. 5
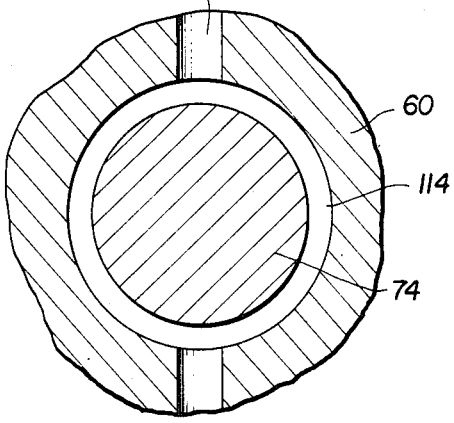
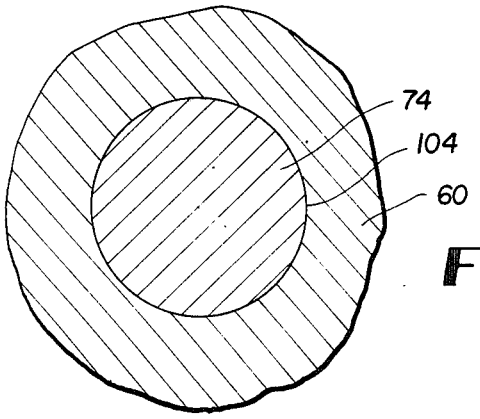
FIG. 6

FIG. 7
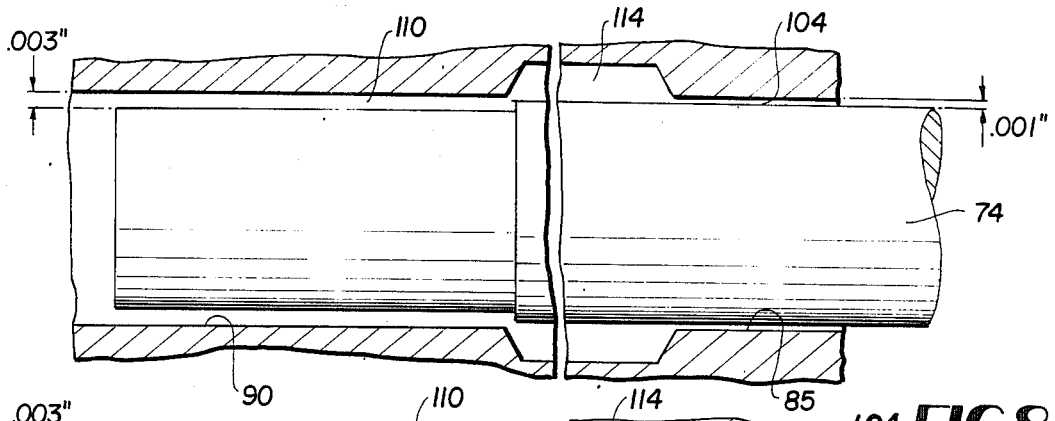
FIG. 8
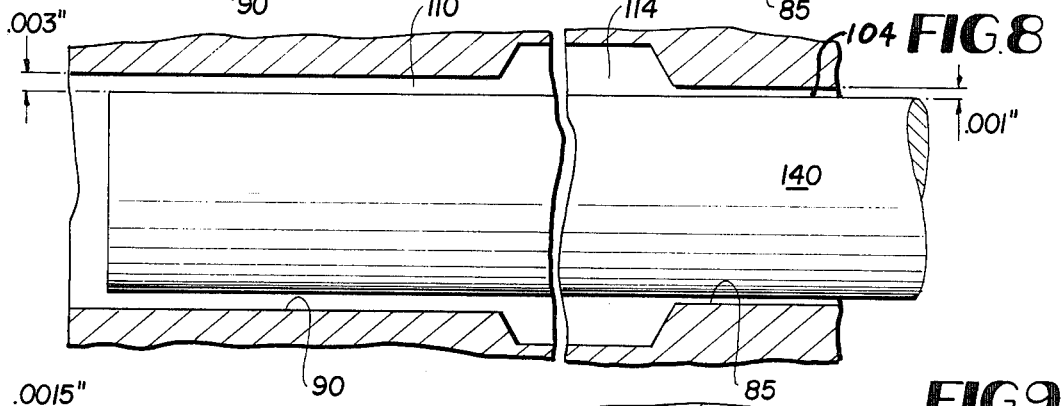
FIG. 9
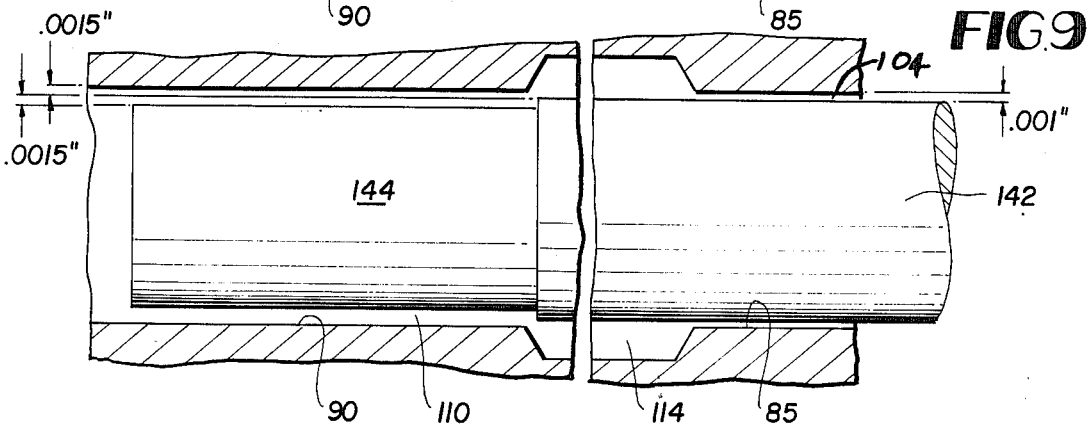
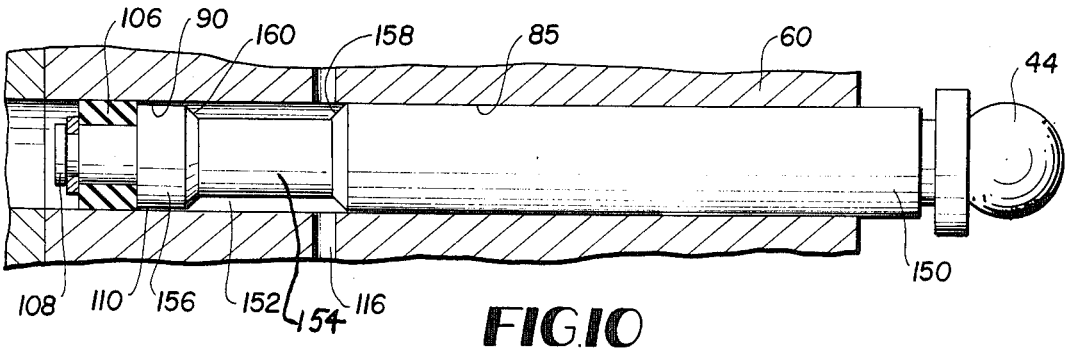
FIG. 10

CONSTANT PRESSURE PUMP

BACKGROUND OF THE INVENTION

1. Field of the Invention

The present invention pertains to an improved high pressure pump for continuously pumping fluids at high pressure. More particularly, the invention relates to the application of a novel piston-cylinder combination which reduces galling and component wear while increasing the overall efficiency and service life of pumps. The reduction in galling is achieved by reducing the diameter of the piston or increasing the inside diameter of the cylinder or both to provide about a 0.1 percent to 2.5 percent increase in clearance at the pressure end of the piston-cylinder combination than is provided by a centering area. The centering area is axially displaced from the pressure end of the piston-cylinder combination and may similarly be formed by modifying the diameter of the piston or cylinder or both to provide a centering area having a 0.1 percent to 2.5 percent closer clearance than the pressure end of the piston-cylinder combination.

The advantages of the present invention are further augmented by providing a release area intermediate the pressure end and the centering area of the piston-cylinder combination. The release area may be formed in the piston-cylinder combination by decreasing the diameter of the piston or increasing the inside diameter of the cylinder or both to provide a chamber. The chamber provided in the preferred embodiment is of an axial length sufficient to accommodate the length of the stroke of the piston and is arranged to accommodate the length of travel of any ridge resulting from a change in piston diameter between the pressure end of the piston and the centering area of the piston-cylinder combination.

The novel piston-cylinder combination is designed to allow the piston to reciprocate in the release area which is slightly longer than the stroke of the piston and allows the area of demarcation on the piston to reciprocate in the release area without touching the cylinder wall and allows the pressure end of the piston to operate without touching the inside diameter of the sleeve to a degree that would result in seizure or galling. The release area in conjunction with the area of demarcation of the novel piston operates in the pressure end of the piston-cylinder combination in such a manner as to allow the pressure end of the piston to essentially operate free from lubricating contamination and galling while providing a release area which allows collected lubricating fluids to drain from the cylinder and minimize the possibility of lubricating fluid contamination in the event of a seal failure.

2. Description of the Prior Art

The prior art includes a variety of mechanical devices for centering pistons in pumps and increasing the sealing properties of the piston and cylinder arrangement. It is recognized that the effectiveness and efficiency of the pumps are increased by properly centering the piston and providing a more effective seal for the piston. Exemplary of one such approach in the prior art to increase the efficiency of the pumps is U.S. Pat. No. 3,916,771 which utilizes a deformable sealing sleeve employed in conjunction with an ordinary piston that is designed to limit the radial and angular displacement of the piston. A deformable sleeve is disposed in a axial channel provided in the housing that surrounds the piston.

Unlike the present invention, the axial cavity provided in U.S. Pat. No. 3,916,771 does not function as a release area and is not by itself for the purpose of reducing galling. In contrast to the cavity provided in the housing of the prior art for accommodating a sealing sleeve or liner, the present invention employs a release area to provide the dual function of reducing galling by cooperating with the modified piston-cylinder combination and which further cooperates with the piston-cylinder combination to provide a fluid discharge area in the event of seal failure to prevent the contamination of the lubricating fluid with a non-lubricating fluid. Furthermore, the prior art unlike the present invention does not utilize a specially designed piston for cooperation with a cylinder and a release area in the cylinder to accomplish the results of the present invention. More particularly, the prior art has generally employed pistons of the same diameter whereas the present invention utilizes modifications of the piston-cylinder combination to provide for the centering of the piston and a reduction of the galling potential in pumps.

In U.S. Pat. No. 3,902,404 a deformable sleeve is provided for surrounding a piston of a uniform diameter to improve the sealability of the pump in high and low pressure ranges. A series of peripheral grooves **19*a*** are provided in a deformable sleeve to assist in the centering of the piston which as described in the prior art patent is particularly useful at low pressure operations. Unlike the prior art, the present invention employs a piston of a slightly reduced circumferential diameter to reduce component wear. Centering of the piston in prior art Patent 3,902,404 is provided for in a manner that is similar to U.S. Pat. No. 3,916,771. The present invention unlike these prior art patents provides a novel arrangement of elements and the utilization of the piston-cylinder combination in an area of reduced pressure for centering the piston and thereafter utilizing a greater clearance at the pressure end of the piston-cylinder combination for reducing galling and component wear of novel pumps constructed in accordance with the invention.

In U.S. Pat. No. 3,811,798, the pump disclosed utilizes a piston of reduced diameter having a means for sealing the pumped fluid from the lubricating fluid. The manner in which this prior art patent accomplishes its objectives is the utilization of a slidable O-ring for opening and closing a lubricant return passageway disposed between the cylinder bore and a passage which is opened and closed by the reciprocating action of the piston. U.S. Pat. No. 3,811,798 employs a piston having two portions of different diameter but unlike the present invention does not utilize a piston-cylinder combination to provide the advantages of the present invention. In U.S. Pat. No. 3,811,798 the cylinder is divided into two chambers by an annular member 93. The pressure end of the piston operates predominantly in the pressure portion of the piston-cylinder combination while the wider diameter portion 77 reciprocates in portion 64 of the cylinder. The size of bore 64 in relation to bore 80 is not specified, however the difference in size of the piston is specified as being about 0.010 inches smaller. Even assuming a cylinder of a uniform bore, which appears contrary to the teaching on column 4 lines 60–63, the present invention is distinguishable from the prior art in the arrangement and provision of additional components to provide the advantages of the invention.

Furthermore the invention described in U.S. Pat. No. 3,811,798 is not for the relationship in the cylindrical bore but instead for the sliding O-ring valve 68.

The present invention in contrast employs a piston-cylinder combination of two different diameters which cooperate in a pressure area and centering area in combination with a release area. Unlike the prior art, the present invention provides a release area to accommodate the reciprocation of the area of demarcation between the larger and smaller diameter portions of the piston. The utilization of a sleeve of a substantially uniform diameter except for the release area operates to achieve the advantages of the present invention over the prior art. The release area further serves as an area to prevent the contamination of the pumped fluid from the lubricating fluid in the event of seal failure while providing a release area of an axial length sufficient to allow the larger portion of the piston to operate in a release area to reduce piston to cylinder wall contact and increase component life. Similarly, the forward end of the piston being of a reduced diameter has already been centered by the action of the centering area of the piston-cylinder combination located away from the pressure area of the piston-cylinder combination which allows the pump to operate more effectively.

The prior art pump and piston-cylinder combinations generally focus on the problem of increasing the efficiency of the seal or the problem of centering the piston as a means for increasing the efficiency of the components and decreasing the potential for galling. The present invention in contrast divides the piston into a pressure end and a driving or centering end and modifies the piston-cylinder combination by reducing the diameter of the piston or increasing the inside diameter of the cylinder or both at or near the pressure end of the piston-cylinder combination and providing a release area between the pressure end and centering portion of the piston-cylinder combination which the axial length of in combination with the release area is designed to accommodate the stroke or length of travel of the ridge formed between the larger diameter and the smaller diameter portions of the piston. This combination of elements operates to simultaneously increase the efficiency of the seal system and additionally provides a valuable back up in the event of seal failure while providing the advantages incumbent in a pump which exhibits a decreased tendency to seize or to gall.

In one embodiment of the invention a small diameter pressure end of a piston is utilized to provide a larger clearance in the pressure end of the piston-cylinder combination in conjunction with the piston centering advantages achieved by utilizing a larger diameter portion of the piston in the rearward portion of the sleeve to provide a smaller clearance in the piston-cylinder combination at the centering area to increase seal efficiency by reducing the incidence of cylinder wall scarring by the piston. Furthermore, the disposition of the stepped portion of the piston in the release area further increases component life by assuring that frictional vibrations and losses are kept to a minimum while providing an important back-up system in the event of seal failure.

The release area further serves as a lubricant or oil drain from the cylinder area and prevents the contamination of the lubricating fluid and pumped fluids. The configuration of the novel piston in conjunction with the release area even more importantly reduces the number and wear on seals and the consequent cost in manufacture and maintenance of the pump while removing the major cause of galling and pump seizure. These advantages are achieved utilizing a novel design which furthermore reduces the cost of manufacturing and assemblage of the novel pump while increasing the service life of the piston-cylinder components.

SUMMARY OF THE INVENTION

The disadvantages and limitations of prior art high pressure pumps including the problem of seizure, galling and the problems of piston and cylinder wear are reduced by utilizing the novel piston-cylinder combination of the present invention. The novel piston-cylinder combination of the present invention is particularly advantageous for increasing the service life of the piston-cylinder combination in high pressure pumps that are capable of supplying a non-lubricating fluid at a constant pressure in the range of 10,000 p.s.i. at 4.5 to 6 gallons per minute. Novel pumps constructed in accordance with the invention further provide a simple but effective seal backup which in the event of seal failure operates to prevent contamination of the pumped non-lubricating fluids with the lubricating fluid.

The present invention achieves advantages in reducing component wear and diminution of seizure and galling by modifying the piston-cylinder relationship by providing a pressure area and a centering area that is axially displaced from the pressure area of the piston-cylinder combination. The pressure area of the piston-cylinder combination is modified by increasing the clearance between the piston and cylinder in the pressure area by reducing the diameter of the piston or by increasing the inside diameter of the cylinder, or both. Axially displaced from the pressure area of the piston-cylinder combination is the centering area which has a decreased clearance between the piston and cylinder. The difference in clearance between the piston and cylinder in the pressure area is compared with the centering area is about a 0.1 percent to 2.5 percent decrease in clearance in the pressure area of the piston cylinder combination. Intermediate the pressure area and centering area is a release area which forms a chamber between the piston wall and cylinder wall by increasing the inside diameter of the cylinder in this area or reducing the diameter of the piston in this area, or both. Preferably the axial length of the release area is sufficient to accommodate the reciprocal travel of any ridge formed in the piston as a result of providing a decrease in diameter between the pressure area and centering area of the piston-cylinder combination.

The present invention is the product of an extensive research investigation into methods and systems for reducing the abrasion and wear on the piston and cylinder components in pumps. The invention is particularly applicable to high pressure pumps capable of continually delivering fluids, and particularly non-lubricating fluids at a pressure of about 10,000 pounds per square inch at a rate of about 4.5 to 6 gallons a minute of non-lubricating fluid. The principles of the invention are particularly adaptable to high pressure water pumps which are employed in scaling operations. In the course of the investigation which led to the present invention it was discovered that the wear and abrasion of piston and cylinder components and the propensity for seizure and galling in high pressure pumps could be reduced by a modification of the piston and cylinder relationship. More particularly, it was discovered that by slightly increasing the clearance at or near the pressure end of the piston in combination with providing a release area in the cylinder wall served to provide advantages in effectively centering the piston to reduce galling and component wear while providing a relief chamber to prevent the contamination of piston lubricating fluid with the non-lubricating fluid in the pump in the event of seal failure.

The advantages of the invention may be achieved by increasing the clearance between the piston and cylinder at the pressure end of the piston-cylinder combination by reducing the diameter of the pressure end of the piston, increasing the inside diameter of the cylinder at the pressure end or doing both while maintaining the clearance at the centering area or portion of the piston-cylinder combination. Typically the advantages of the invention are achieved by providing about 0.1 percent to 2.5 percent greater clearance in the pressure end than in the centering portion of the piston-cylinder combination. In application of the invention to a variety of pump designs it is possible to achieve the advantages of the invention by utilizing a clearance of about 0.001 inch to 0.0025 inch for a piston-cylinder combination which has a centering area about 2 inches long and a piston of about one half inch in diameter. It will be recognized that other tolerances are possible in application of the invention to larger equipment since the clearance in the centering portion of the piston provides for lubrication of the sliding piston.

The pressure end of the piston-cylinder combination is about one inch long and utilizes a clearance in the range of about 0.1 percent to 2.5 percent greater than the clearance provided in the centering area. In the preferred embodiment a total clearance in the pressure end is about 0.003 inches and may be achieved by decreasing the diameter of the piston at the pressure end by 0.002 inches or by increasing the inside diameter of the cylinder by 0.002 inches at the pressure end or a combination of both to provide the additional clearance.

In the preferred application of the present invention to high pressure fluid pumps a release area of about ⅝th of an inch in axial length and about 1/16th of an inch or greater diameter than the inside diameter of the cylinder is provided intermediate the centering area and the pressure area of the piston-cylinder combination. The release area is preferably of an axial length slightly longer than the length of the stroke of the piston so that any ridge in the piston formed as a result of a change in diameter to provide the clearance between the centering area and pressure area reciprocates entirely within the axial length of the release area. The release area is vented so that any accumulation of oil does not flow further along the piston-cylinder combination and does not contaminate the pumped fluid. The release area also functions as a relief chamber that is connected to a relief port which prevents the mixture or contamination of the lubricating fluid with the pumped fluid in the event of seal failure at the pressure end of the piston-cylinder combination.

The foregoing discussion of the relationship of the clearances and pressure area, centering area and release area and axial lengths have been described with reference to a pump having a piston of about ½ inch in diameter and a total cylinder length of about 3½ inches and a piston travel of about ½ inch in the cylinder. It will be recognized that the advantages of the present invention can be utilized with a variety of different pumps having different lengths of piston travel or strokes in the cylinder and different dimensions by modifying the relationship of clearance and pressure area, release area and centering area in accordance with the invention.

In a preferred embodiment of the invention the novel piston-cylinder relationship was achieved by employing a piston having a reduced diameter at about one inch from the pressure end in a pump having a total cylinder length of about 3½ inches. The size of the reduction in the diameter of a piston of about ½ inch in diameter is approximately 0.002 inches smaller than the outside diameter of the rest of the piston. In larger pumps, as discussed, the reduction in size in the diameter of the pressure end of the piston can be increased while maintaining the proportional advantages of the invention.

In the preferred embodiment the axial length of the release area roughly corresponds to the length of travel of the ridge or line of demarcation between the area of reduced diameter and the remaining portion of the piston. The release area is disposed in the cylinder wall in such a manner that it cooperates with the line of demarcation and the pressure area and centering area of the piston. The novel pump consequently in its preferred embodiment has a small portion of the larger diameter of the piston and a major portion of the reduced diameter portion of the piston in the release area at the bottom dead center position of the piston. Conversely, at the top dead center position of the piston, the release area accommodates a major portion of the larger diameter area of the piston and a minor portion of the area of reduced diameter of the piston.

In operation the ridge or boundary between the area of reduced diameter and ordinary diameter of the piston reciprocates in its entirety in the release area while the major portion of the piston which is of a smooth circumferential configuration having a uniform diameter slides without ridges or projections in the centering area of the cylinder. The rearward portion of the piston therefore serves as a centering or piston positioning means for maintaining the piston centered in the cylinder while the portion of the reduced diameter efficiently operates in the pressure end of the cylinder. The cylinder or sleeve in this embodiment is, of course, of a substantially uniform inside diameter except for the release area which has been provided in the cylinder.

The advantages of the present invention result in part from the combined utilization of the release area to accommodate the division between the stepped down portion of the piston and the body of the piston. It will be recognized that the greater the travel of the piston the greater the axial length of the release area. In addition as discussed the diameter of the pressure end of the piston should be about 0.1 percent to 2.5 percent less than the diameter of the remainder of the piston. In the preferred embodiment of the present invention the pressure end of the piston has a decrease in diameter of about 0.4% or about 0.002 inches.

In most applications, it is advantageous to place a U-cup, seal or gasket at the end of the piston. The U-cup or seal placed at the pressure end of the piston may be of the same diameter as the pressure end of the piston or the same diameter as the centering area particularly where the seal is composed of a resilient material. In optimizing the advantages of the present invention, it will further be recognized by those skilled in the art that various metallurgical treatments of the piston-cylinder combination may be utilized such as are standard in the art to further increase the advantages of the invention. The sleeve or cylinder portion also may be formed from bronze and other metallurgical compositions to augment the advantages of the invention.

The novel aspects of the present invention may be achieved by increasing the clearance at the pressure portion of the piston-cylinder combination or increasing the inside diameter of the pressure portion of the cylinder or a combination of both. The advantages of the present invention are incumbent in the provision of a pump having reduced wear on piston and cylinder components while providing a significant reduction in the tendency of high pressure pumps to seize or gall in operation. In addition, the utilization of a release area provides a positive back-up in the event of seal failure to prevent contamination of the pump lubricating fluid with the pumped non-lubricating fluid. Moreover, as a consequence of the design and construction, the invention is more easily manufactured and assembled than prior art systems which provide only one advantage such as, for example, the centering of the piston.

DESCRIPTION OF THE DRAWINGS

Other advantages of the invention will become apparent to those skilled in the art from the following detailed description of the invention in conjunction with the accompanying drawings in which:

FIG. 2 is a fragmentary enlarged cross-section view illustrating the position of a piston and cylinder in the extreme forward position;

FIG. 3 is a fragmentary cross-section view similar to FIG. 2 illustrating the piston in the extreme rearward position;

FIG. 4 is a cross-section view of FIG. 1 taken on the line 4—4;

FIG. 5 is a cross-section view of FIG. 1 taken on the line 5—5;

FIG. 6 is a cross-section view of FIG. 1 taken on the line 6—6;

FIG. 7 is a schematic cross-section view showing the clearance between the piston and cylinder combination of FIG. 2 which has been exaggerated for clarity illustrating one embodiment of a novel pump constructed in accordance with the invention;

FIG. 8 is a schematic cross-section view showing the clearance between the piston and cylinder which has been exaggerated for clarity illustrating an alternative embodiment of a novel pump utilizing a modified piston and cylinder;

FIG. 9 is a schematic cross-section view showing the clearance between the piston and cylinder which has been exaggerated for clarity illustrating an alternative means for providing a modified piston and cylinder; and FIG. 10 is a fragmentary enlarged cross-section view of a novel pump illustrating a further embodiment of a piston designed to provide the advantages of the invention.

DETAILED DESCRIPTION OF THE INVENTION

Figure 1:
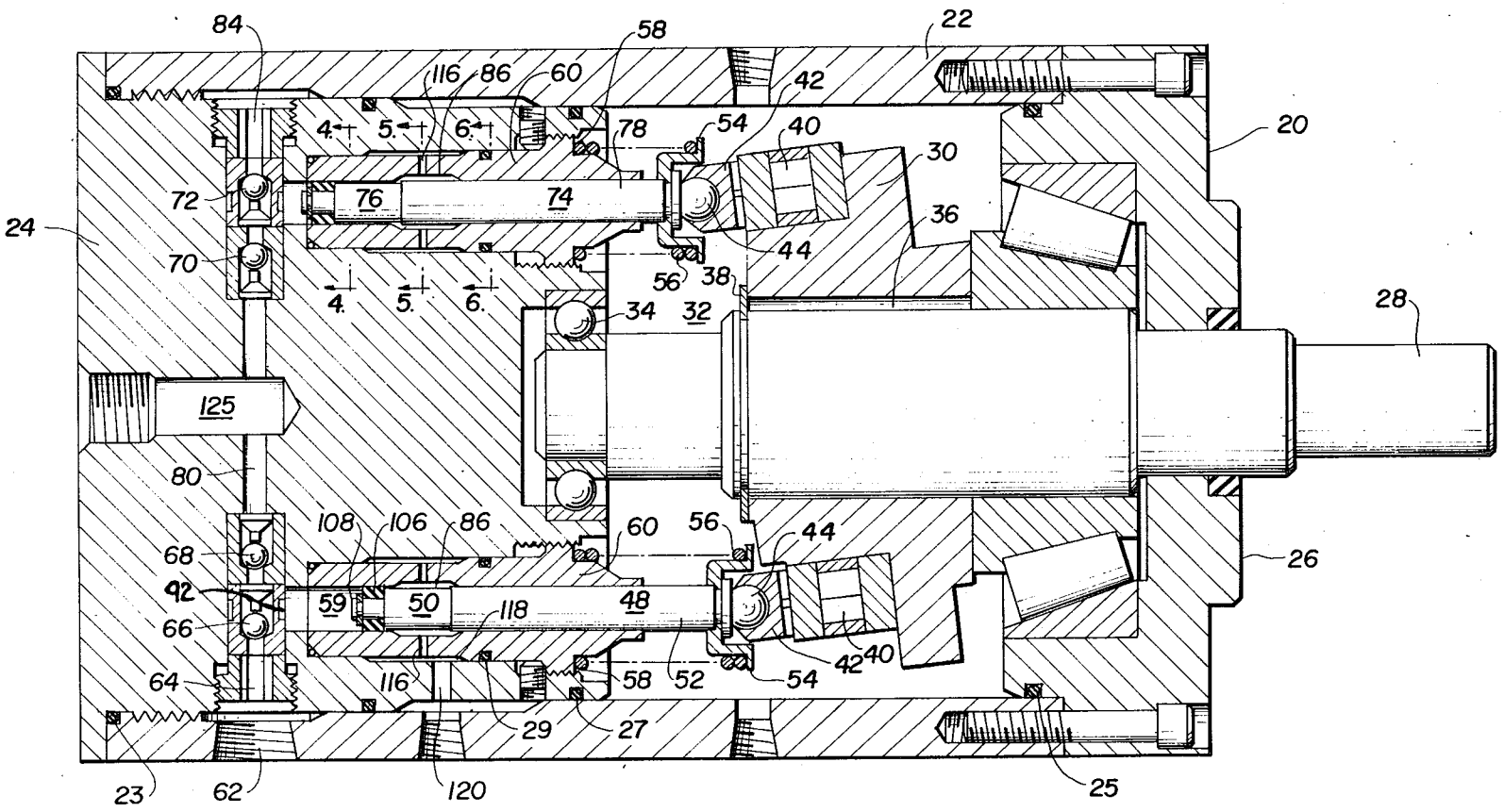
FIG. 1 is a longitudinal cross-section through the pump assembly of a novel pump constructed in accordance with the invention.

Referring now to FIG. 1, a pump 20 has been partially cut away to illustrate a cylindrical pump wall 22 which is enclosed at one end by a pump head 24 and is enclosed at the other end by a front cap 26. O-ring seals 23 and 25 are employed to close pump wall 22 to provide a fluid tight housing. A rotatable shaft 28 is disposed in front cap 26 which provides for rotation of cam 30. Shaft 28 extends through a cavity 32 in pump 20 and is rotatably secured to pump head 24 by a bearing 34 provided in pump head 24.

Cavity 32 in operation is partially filled with oil to provide lubrication for the rotatable shaft, bearings, pistons, cylinders and other moving parts in the novel pump. O-ring seals 25, 27 and 29 are provided to seal cavity 32 which is filled with a lubricating fluid from the non-lubricating fluid. Cam 30 is secured to shaft 28 by utilization of a slot (not shown) provided in shaft 28 and a corresponding key 36 which is maintained in its position by a ring retainer 38.

Associated with cam 30 is a number of first thrust bearings 40 which correspond to the number of pistons disposed on cam 30 which connect with a number of second thrust bearings 42 which connect to a ball 44 which is associated with one end of a piston 48 so that rotation of shaft 28 translates rotational energy into the reciprocal motion of pistons 48 and 74. While the present invention is being described with respect to the utilization of a cam it will be recognized that the invention is applicable to various mechanical mechanisms such as crankshafts and the like means for translating rotational energy into reciprocal energy. The invention is particularly adaptable to continuous high pressure pumps such as water pumps where the pump delivers a continuous high pressure at 10,000 p.s.i. at a rate of about 4.5 to 6 gallons of water per minute.

Pistons 48 and 74 are identical except for their positions in the cylinder, with each piston having a pressure end 50 and 76 respectively and a driven end 52 and 78 respectively which is adjacent ball 44 of the pistons. A spring retainer 54 is designed to engage the driven end 52 of piston 48 and driven end 78 of piston 74 and a bias springs 56 against a second spring retaining member 58 conveniently provided on cylinder members 60. Fluid pump 20 generally pumps a non-lubricating fluid that is different from the lubricating fluid maintained in cavity 32 which lubricates pistons 48 and 74 in cylinder 60. The non-lubricating fluid enters pump 20 via a conduit port 62 by the action of pistons 48 and 74 in cylinder 60. An inlet fluid port 62 is connected via a duct 64 by the operation of a first check valve 66 and a second check valve 68 allowing the non-lubricating fluid to be drawn into the pressure end 59 of cylinder 60 on the expansion stroke of piston 48. Similarly, a second pair of check valves 70 and 72 are designed to cooperate with piston 74 in a manner similar to that described with respect to piston 48. A passage 80 interconnects the first pair of check valves 66 and 68 with the second pair of check valves 70 and 72 of piston 74 which operate in a manner known to those skilled in the art to provide a continuous fluid pressure. The pumped fluid is transported from pump 20 via an outlet 125.

Referring now to FIGS. 1, 2 and 3, advantages of the present invention are illustrated by way of description of a preferred embodiment of the invention wherein a specially constructed piston-cylinder combination is utilized in combination with a release area as will be described in greater detail hereinafter. In FIGS. 1 and 2 piston 74 is illustrated at its top dead center position. Pistons 74 and 48 are identical except for their position in the cylinder and are designed in such a manner that pressure end 76 is about 1 inch long and is approximately 0.002 inches smaller in diameter than the remaining portion of piston 74. The reduction in diameter of the pressure end 76 of pistons 74 and 48 results in the formation of a small ridge 102 on pistons 74 and 48. The diameter of pistons 74 and 48 from ridge 102 to centering ends 78 and 52 respectively is substantially of the same diameter which is designed to securely fit in cylinder 60 such that the space 104 (FIG. 6) provided between pistons 74 and 48 and the wall of cylinder 60 is within the tolerances generally applicable to high pressure pumps which in the case of a pump having pistons of one half inch in diameter is from about 0.001 to 0.002 inches. The clearance ideally is sufficient to allow oil from cavity 32 to lubricate the sliding surfaces of centering ends 78 and 52 while being sufficiently close to limit radial and angular movement of the piston. This interface between piston 74 and cylinder 60 at the centering area is illustrated in FIG. 6 as being a small space 104 represented by ridge or line 104. The operation of the centering area is illustrated in FIGS. 2, 3, 4, 5 and 6 by comparing the length of the piston stroke between the top dead center (FIG. 2) and bottom dead center positions of the piston in cooperation with the modified configuration of the piston-cylinder combination.

From the opening 81 of cylinder 60 to the taper 83 constitutes a centering area 85 for the piston-cylinder combination wherein the tolerance is maintained at about 0.001 to 0.002 inches. A release area 86 is formed in cylinder 60 from taper 83 to taper 88. The depth of the release area is about 1/16th of an inch although other dimensions for the annular chamber forming the release area are feasible. A pressure area 90 is formed in the remaining portion of cylinder 60 from taper 88 to the outlet 92 of the cylinder.

An optional seal or U-cup 106 is provided at the pressure ends 76 and 50 of pistons 74 and 48 respectively. The U-cup or seal 106 is fastened to pressure ends 76 and 50 by traditional fastening means 108. The U-cup 106 may be either of the same diameter as pressure ends 76 and 50 of pistons 74 and 48 or alternatively the same diameter as driven end 78 since U-cup 106 is generally formed from teflon, rubber, or some other resilient material which does not exhibit a tendency to seize or gall in high pressure operations. In addition, U-cup 106 may be eliminated in certain operations without departing from the novel aspects of the present invention.

Pressure ends 76 and 50 of pistons 74 and 48 are of a reduced diameter and are designed to reciprocate in pressure area 90 of cylinder 60 resulting in a small clearance 110 between piston 78 and cylinder 60. The clearance 110 is achieved by reducing the diameter of pistons 74 and 48 by from about 0.1 percent to 2.5 percent or from about 0.0005 to 0.0125 of an inch. Clearance 110 can be provided also by an increase in the inside diameter of the cylinder or a combination of a decrease in the diameter of the piston and an increase in the inside diameter of the cylinder as will be described hereinafter in greater detail.

A release area 86 is provided intermediate the centering area 85 and the pressure area 90 in cylinder 60. The release area 86 is provided by increasing the inside diameter of cylinder 60 to provide the circumferential release area 86 having a clearance provided by a circular cavity 114 (FIG. 5) that is of an axial length which in the preferred embodiment of the invention is sufficient to accommodate the reciprocal length of travel of piston 74 from its top dead center and bottom dead center positions. Release area 86 is connected by a port 116 to a collection area 118 to be thereafter drained via port 120 from novel pump 20.

The clearance 110 is maintained in operation of the pump as a result of the cooperation between centering area 85 of cylinder 60 in cooperation with driven end 78 of piston 74 to reduce piston wear in the high pressure end of the piston and reduce galling and the possibility of seizure in high pressure pumps. The clearance 110 resulting from this cooperation between the difference in diameter of the pressure end 76 of piston 74 and pressure area 90 of cylinder 60 and piston 74 is predominantly responsible for the novel aspects and advantages of the present invention over the prior art in providing a pump exhibiting reduced component wear and galling. As heretofore discussed, the clearance 110 of about 0.003 inches is generally achieved by maintaining a constant cylinder 60 clearance of 0.001th of an inch and reducing the pressure end of the piston by 0.002th of an inch. However, as will be recognized by those skilled in the art, larger size pistons and sleeves may utilize the advantages of the present invention by an increase in clearances where fluids having a density greater than water are pumped or where larger diameter pistons and cylinders are utilized which maintain the same cooperative relationships. Conversely in the case of light fluids and vapors and clearances would have to be closer even though the advantages of the invention may be achieved by employing the relationship between the components. Consequently, the difference in diameter between pressure portion 76 and the remaining portion of piston 74 should be in the neighborhood of a 0.1 percent to 2.5 percent decrease in the diameter of pressure end 76 where the high pressure non-lubricating fluid being pumped is water and the pistons and cylinders are about ½ of an inch in diameter. The preferred range for the reduction in diameter is from about 0.2 percent to about 1 percent depending upon the viscosity and density of the high pressure pump fluid. In the case of high pressure water pumps, the difference in the preferred embodiment is about 0.4 percent.

Cooperation between release area 86 having a clearance cavity 114 and pistons 74 and 48 is best illustrated in FIGS. 2, 3 and 5. In FIG. 3, piston 48 is contoured in a manner identical to piston 74 which is illustrated in its top dead center position. As can be seen, the ridge 102 resulting from the change in diameter on pistons 48 and 74 is designed to reciprocate in the preferred embodiment entirely within circular cavity 114 of release area 86. The circular cavity 114 is further provided to allow oil migrating between pistons 74 and 48 and cylinder 60 to collect in the release area on the diameter of piston 74. As will be recognized the slight ridge 102 assists in maintaining the lubricating oil in the centering area 85 thereby further preventing contamination of the pumped fluid by the lubricating fluid in normal operation and providing an important relief in the event of seal failure to prevent the pumped fluid from entering cavity 32. Oil collecting in cavity 114 is allowed to collect and drain via drain part 116 from the novel pump 20.

The smaller diameter of pressure end 76 and 50 of pistons 74 and 48 respectively allows the pistons to operate in a nonlubricating pressure area 90 of cylinder 60 without galling once it has already been centered by the cooperation of cylinder 60 with portion 78 of piston 74 and portion 52 of cylinder 60. The area 90 of the pressure end of the piston allows the piston to operate in the release area in a virtually dry condition except for the fluid which is being pumped at the seal end of the piston. The cooperation between the release area 86 and the pressure end 76 of piston 74 and pressure end 50 of piston 48 is further enhanced since any fluid seeping around U-cup 106 or the loss of any seal in the pump results in the fluid not contaminating the lubricating fluid contained in cavity 34. A failure of the U-cup or partial loss of the integrity of a U-cup or seal 106 will result in fluid filling cavity 114 which thereafter results in its discharge via channel 116. The novel combination between the release area 86 and the configuration of the pistons not only provides advantages in centering, reducing wear, and galling of the components of the novel pump of the present invention but also retains the integrity of the lubricating fluid and non-lubricating pumped fluid. The relationship of the ridge 102 provided on piston 74 and 48 and its relationship to the release area in both the top dead center (FIG. 2) and bottom dead center (FIG. 3) with respect to the release area 86 is important since it permits the non-lubricating area of piston 76 to operate without touching the inside diameter of the sleeve to such a degree as to result in galling and seizure and increased wear on the components of the novel piston and sleeve combination. The relationship between pistons 74 and 48 and cylinder 60 in providing the centering by the utilization of clearance 104, cavity 114 and clearance 110 may be accomplished by a variety of alternative embodiments.

Referring now to FIGS. 7, 8, and 9 the clearances for a water pump having pistons of a diameter of about ½ an inch is illustrated in exaggerated detail showing the relationship between clearance 104, cavity 114 and clearance 110. In FIG. 7, the utilization of the cavity 114 and clearances, 104 and 110 are illustrated as heretofore has been discussed in reference to FIGS. 1, 2, 3, 4, 5, and 6 by employing a cylinder 60 of a uniform bore in the centering area 85 and pressure area 90. In FIG. 8, the advantages of the present invention are achieved by employing a piston 140 of substantially uniform diameter from the driven end to the pressure end. In essence, in this embodiment the piston 140 does not include a portion of different diameter as has heretofore been described but achieves the advantages of the present invention by a modification of the cylinder wall 60, particularly in the pressure area 90. More particularly, the clearance between piston 140 and cylinder wall 60 in the pressure area 90 is maintained by providing the centering of the piston in the centering area 85 by providing a tolerance of about 0.001th of an inch. The relationship of release area 86 provided by cavity 114 is similarly maintained, however, since piston 140 is of a constant diameter, the axial length of cavity 114 may be of reduced diameter since a ridge such as for example, ridge 102 on FIGS. 2 and 3 is not present. The utilization of the principles of the present invention, however, are achieved by modifying the pressure area 90 by increasing the inside diameter of cylinder 60 by 0.002th of an inch to achieve a total clearance of about 0.003th of an inch. Or, in other words, instead of decreasing the size of the pressure end of piston 140 in the range of about 0.1 percent to 2.5 percent, the inside diameter of cylinder 60 at the pressure area 90 is increased by the percentage of about 0.1 percent to 2.5 percent clearance utilized to achieve the advantages of the invention.

In FIG. 9, the advantages of the present invention are obtained by a combination of increasing the inside diameter of cylinder 60 and decreasing the diameter of a modified piston 142. In FIG. 9, clearance 104 is maintained at about 0.001th of an inch to provide for the centering of the pressure end 144 of piston 142. The relationship of the release area and the cavity 114 provided therein is maintained with respect to piston 142 as has heretofore been described with respect to the embodiments of FIGS. 1, 2, and 3. Piston 142 is modified at the pressure end 144 by reducing the diameter of the pressure end by about 0.0015th of an inch while increasing the inside diameter of cylinder 60 at the pressure area 90 at a corresponding amount of 0.0015th of an inch to provide a total clearance at clearance 110 between the piston and the cylinder in the range of about 0.1 percent to 2.5 percent. It will be recognized that various modifications may be made to the diameters of the cylinder and the piston and the relationship thereto to provide for the centering and reduction of wear of the piston and cylinder components to achieve the advantages of the present invention. It will be recognized that these changes and modifications may be made with respect to the finishing and surface treatments of the piston and cylinder components which also modify the diameters of the components and are within the teaching of the present invention.

Referring now to FIG. 10, a further modification is illustrated with respect to the relationship of cylinder 60 to a further modified piston 150. The relationship between cylinder 60 and piston 150 is maintained by a further modification in the relationship between the piston and the cylinder 60. More particularly, cylinder 60 is of a constant diameter from one end to another including centering area 85 and pressure area 90. A port 116 is provided in cylinder wall in an area that roughly corresponds to its position with respect to the release area described with respect to other embodiments of the invention. A seal 106 is provided on piston 150 along with a fastener 108 as has been described with respect to other embodiments of the invention. The release area 152 is provided on the piston by tapering piston 150 at the portion of the piston 154 just before pressure end 156. Release area 152 is provided by circumferentially tapering piston 150 at points 158 and 160 to provide the release area which serves to function in cooperation with the cylinder 60 in a manner similar to the release area 86 as heretofore described where a cavity 114 was provided in the cylinder wall. The major difference in operation between release area 86 and 152 is that fact that release area 152 reciprocates with piston 150. The relationship between clearance 104 is maintained as heretofore described with respect to other embodiments of the invention as described in FIGS. 1–9 while the relationship between the pressure end 156 and cylinder wall 60 is maintained by reducing the diameter of the pressure end 156 by 0.002th of an inch to provide a clearance where the diameter of the piston is about ½ of an inch from about 0.1 percent to 2.5 percent of the diameter of the piston.

It will be recognized the present embodiment can further be modified by combining the advantages of a reciprocating release area provided by 154 with a static release area such as provided by cavity 114 by increasing the inside diameter of the cylinder 60 such as has been described with respect to FIGS. 7 through 9. Similarly, the relationship between pressure end 156 of piston 150 and pressure area 90 of cylinder 60 may be modified by increasing the inside diameter of cylinder 60 by increasing the size of the piston or alternatively providing an arrangement such as provided in FIG. 8 wherein pressure end 156 is of the same diameter as the remaining portion of piston 150 with the centering of pressure end 156 being achieved by decreasing the inside diameter of cylinder 60 to provide the advantages of the present invention.

The novel pump of the present invention provides numerous advantages over high pressure water pumps of the prior art by allowing fluids to be continuously pumped at high pressure in range of about 10,000 pounds per square inch from about 4.5 to 6 gallons per minute while reducing galling and wear upon component parts and reducing the scarring and damage to the piston and cylinder components. The present invention further provides advantages in reduced maintenance, and increased efficiency by providing a convenient means for centering the pistons at a non-pressure location since the problem of centering is not compounded with the problem of increased pressure at the pressure end of the piston and cylinder combination which fosters seizures in pumps and high pressure equipment. The present invention further provides increased advantages over the prior art by maintaining a back-up to the fluid seal arrangement to prevent contamination of the lubricating fluid with non-lubricating pumped fluid in case of component failure. The advantages of the present invention may be further combined with various means for the return of oil transported via port 116 while providing a pressure sensitive valve to open the port in the event of seal failure and other such modifications as will occur to those skilled in the art. The advantages of the present invention may further be utilized in such an embodiment by providing a means for re-routing oil and fluids where the oil could become contaminated with the pump fluid to provide a quick release drain.

The novel design of the pump as constructed in accordance with the invention further provides for a reduction in pump failures and seizures resulting from galling and other problems regarding abrasion of pump pistons with cylinder walls. The present invention further increases and enhances the operability and efficiency of high pressure pumps since any ridges or projections resulting from a change in diameter of the piston may be accommodated in a release area of larger diameter so that the integrity of uniform sliding surfaces are maintained in the operation of the high pressure pump. Moreover, as a consequence of its design and construction, the novel pump of the present invention is of increased utility and operability by reducing required maintenance and increasing serviceability and operational life of the components of the novel pump.

As will be recognized by those skilled in the art, the present invention has a wide range of applicability to various types of fluid pumps of various sizes and configurations, while providing a superior relationship between the piston and cylinder to reduce pump seizer, maintenance and galling. The invention may be implemented in a variety of ways and various embodiments are contemplated for increasing and decreasing diameters of various components of the cylinder and piston relationship while alleviating and dampening the deleterious effects of vibrational and pressure forces that would otherwise result in increased piston and cylinder wear. It will be further appreciated that the present invention may be implemented in a variety of ways to suit particular applications with or without the use of a release area. It is contemplated that these and other modifications and applications of the present invention may be made to a variety of systems and may be made within the spirit and scope of the invention as defined in the following claims.

What is claimed is:

1. An improved pump for providing a reduction in seizure, galling and operational wear on piston and cylinder components comprising:

(a) a piston, said piston having a pressure end of a first diameter and a driven end of a second diameter and a ridge disposed intermediate said first and second diameters;

(b) a cylinder, said cylinder having a centering end and a pressure end wherein said driven end of said piston is disposed in said centering end of said cylinder to provide a centering area with a first clearance sufficient to allow lubrication of said driven end of said piston and wherein said pressure end of said piston is disposed in said pressure end of said cylinder to provide a pressure area having a second clearance of about 0.1 percent to 2.5 percent greater than said first clearance in said centering area in relation to the diameter of said piston; and (c) a cavity forming a release area disposed in said cylinder intermediate said centering area and said pressure area of said piston-cylinder combination said release area having a radial depth and an axial length sufficient to form said cavity in said cylinder of a length equivalent to or slightly greater than the length of the stroke of said piston in said cylinder wherein said ridge of said piston in operation reciprocates only within said cavity of said release area without ever entering said centering area or said pressure area of said cylinder.

2. The improved pump for providing a reduction in seizure, galling and operational wear on piston and cylinder components of claim 1 wherein said second clearance is provided by reducing the diameter of said pressure end of said piston and disposing said piston in a cylinder having a uniform inside diameter at said centering end and at said pressure end.

3. The improved pump for providing a reduction in seizure, galling and operational wear on piston and cylinder components of claim 1 wherein said second clearance is provided by both increasing the inside diameter of said cylinder at the pressure end of said cylinder and by reducing the diameter of said piston at said pressure end of said piston.

4. The improved pump for providing a reduction in seizure, galling and operational wear on piston and cylinder components of claim 1 wherein said second clearance is in the range of about 0.2 to 0.6 percent.

5. The improved pump for providing a reduction in seizure, galling and operational wear on piston and cylinder components of claim 4 wherein said second clearance is about 0.4 percent.

6. The improved pump for providing a reduction in seizure, galling and operational wear on piston and cylinder components of claim 1 wherein said first clearance is 0.001th of an inch and said second clearance is 0.003th of an inch and wherein said piston is 0.5 inch in diameter.

7. The improved pump for providing a reduction in seizure, galling and operational wear on piston and cylinder components of claim 6 wherein said second clearance is provided by reducing the diameter of said pressure end of said piston by 0.002th of an inch and disposing said piston in a cylinder having a substantially uniform inside diameter at said centering end of said pressure end and wherein said centering area provides a clearance of about 0.001th of an inch.

8. The improved pump for providing a reduction in seizure, galling and operational wear on piston and cylinder component of claim 7 wherein said release area is of a slightly greater axial length than the total operational reciprocal motion of said piston in said cylinder and said radial depth of said release area provides said cavity with a third clearance in the piston-cylinder combination of about 1/16th of an inch to about ½ inch.

9. The improved pump for providing a reduction in seizure, galling and operational wear on piston and cylinder components of claim 8 wherein a ridge formed between said pressure end of said piston and said drive end of said piston reciprocates in its entirety in said release area.

10. An improved piston and cylinder combination which minimizes seizure and wear on piston and cylinder components comprising a piston having a centering end of an axial length of about 10 to 80 percent of the length of said piston and a pressure end of an axial length of about 5 to 30 percent of the length of said piston and a ridge of said piston between said centering end and said pressure end, said piston disposed for reciprocal travel within a cylinder having a centering end and a pressure end wherein said centering end of said piston is disposed in said centering end of said cylinder to form a centering area having a first clearance sufficient to allow lubricant to flow between the contacting surfaces of said piston and said cylinder at said centering area of said piston-cylinder combination and a pressure area at the other end of said piston-cylinder combination wherein said pressure area has a second clearance of about 0.1 to 2.5 percent greater clearance than said first clearance in said centering area in relation to the diameter of said piston said cylinder having a cavity forming a release area in said cylinder by a radical increase of the inside diameter of said cylinder intermediate said centering area and said pressure area by an axial length equivalent to or slightly greater than the length of the piston stroke wherein said pressure end of said piston and said ridge on said piston in operation reciprocates in said pressure end of said cylinder and said cavity of said release area of said cylinder without entering said centering area of said cylinder.

11. The improved piston and cylinder combination which minimizes seizure and wear on piston and cylinder components of claim 10 wherein said second clearance is formed by utilizing a piston having a substantially uniform diameter in said centering end and in said pressure end and wherein said cylinder has about a 0.1 to 2.5 percent increase in inside diameter in relation to the diameter of said piston at the pressure end of said cylinder.

12. The improved piston and cylinder combination which minimizes seizure and wear on piston and cylinder components of claim 11 wherein said release area is formed by said radial increase of the inside diameter of said cylinder from about 1/16th to ½ inch intermediate said pressure area and said centering area of said piston-cylinder combination.

13. The improved piston and cylinder combination which minimizes seizure and wear on piston and cylinder components of claim 12 wherein said release area is formed in said cylinder intermediate said centering end and said pressure end by increasing the inside diameter of said cylinder by an axial length of about 0.1 to 25 percent greater than the length of said piston stroke.

14. The improved piston and cylinder combination which minimizes seizure and wear on piston and cylinder components of claim 13 wherein said release area provided in said piston-cylinder combination is 15 to 20 percent greater than the length of said piston stroke.

15. The improved piston and cylinder combination which minimizes seizure and wear on piston and cylinder components of claim 10 wherein said second clearance is about 0.1 to 2.5 percent greater than said first clearance in relation to the diameter of said piston and is provided by reducing the diameter of the pressure end of said piston in said piston-cylinder combination wherein said cylinder is of a substantially uniform inside diameter at said pressure end and said centering end of said piston-cylinder combination.

16. The improved piston and cylinder combination which minimizes seizure and wear on piston and cylinder components of claim 15 wherein the axial length of said release area is about 0.1 to 25 percent greater than the length of said piston stroke.

17. The improved piston and cylinder combination which minimizes seizure and wear on piston and cylinder components of claim 10 wherein said second clearance is about 0.2 to 0.6 percent greater than said first clearance in relation to the diameter of said piston and is achieved by reducing the diameter of said pressure end of said piston and increasing the inside diameter of said cylinder at said pressure end.

18. The improved piston and cylinder combination which minimizes seizure and wear on piston and cylinder components of claim 17 wherein the area between the different diameters on said piston reciprocates entirely within said release area.

19. The improved piston and cylinder combination which minimizes seizure and wear on piston and cylinder components of claim 17 wherein the axial length of said release area is about 0.1 to 25 percent greater than the length of said piston stroke.

20. The improved piston and cylinder combination which minimizes seizure and wear on piston and cylinder components of claim 19 wherein the area dividing the different diameters on said piston reciprocates entirely within said release area.

21. An improved high pressure fluid pump having a reduced incidence of seizure and wear on piston and cylinder components comprising:

(a) a piston, said piston having a pressure end axially comprising about 5 to 30 percent of the length of said piston and a centering end axially comprising about 10 to 80 percent of the length of said piston;

(b) a cylinder, said cylinder having at one end a centering end axially comprising about 20 to 60 percent of the length of said cylinder and a pressure end axially comprising about 10 to 70 percent of the length of said cylinder, wherein said centering end of said piston is disposed in said centering end of said cylinder to provide a centering area having a first clearance sufficient to allow the flow of lubrication and a pressure area disposed at the other end having a second clearance of about 0.1 to 2.5 percent greater than said first clearance in said centering area in relation to the diameter of said piston; and (c) a cavity forming a release area disposed in said cylinder intermediate said centering area and said said pressure area formed by a radial increase in the inside diameter of said cylinder of an axial length slightly longer than the reciprocal travel of said piston in said cylinder wherein said pressure end of said piston in operation reciprocates only within said pressure end of said cylinder and said cavity of said release area in said cylinder without ever entering said centering area of said cylinder.

22. The improved high pressure fluid pump having a reduced incidence of seizure and wear on piston and cylinder components of claim 21 wherein said second clearance is obtained by a reduction in the diameter of said pressure end of said piston and wherein a ridge formed by the reduction of said diameter of said piston reciprocates in said release area.

23. The improved high pressure fluid pump having a reduced incidence of seizure and wear on piston and cylinder components of claim 22 further comprising a seal provided at the pressure end of said piston.

24. The improved high pressure fluid pump having a reduced incidence of seizure and wear on piston and cylinder components of claim 23 wherein said reduced diameter of said piston and seal comprises about 5 to 20 percent of the length of said piston, said centering area comprises about 50 to 70 percent of the length of said piston and said release area comprises about 10 to 15 percent of the length of the piston.

* * * * *